US005549013A

United States Patent [19]

Kimbara

[11] Patent Number: 5,549,013

[45] Date of Patent: Aug. 27, 1996

[54] STEPPING ACTUATOR

[75] Inventor: Masahiko Kimbara, Tsukuba, Japan

[73] Assignee: Three-D Composites Research Corporation, Tsukuba, Japan

[21] Appl. No.: 556,832

[22] Filed: Nov. 2, 1995

Related U.S. Application Data

[62] Division of Ser. No. 166,886, Dec. 15, 1993, abandoned.

[30] Foreign Application Priority Data

Dec. 15, 1992 [JP] Japan ..... 4-354183

[51] Int. Cl.[6] ..... F01B 3/00

[52] U.S. Cl. ..... 74/129; 74/128; 92/33

[58] Field of Search ..... 74/128, 129; 92/31, 92/32, 33

[56] References Cited

U.S. PATENT DOCUMENTS

| | | | |
|---|---|---|---|
| 4,196,654 | 4/1980 | Stearns | 92/31 |
| 4,534,235 | 8/1985 | Mitcham et al. | 74/129 |
| 4,570,724 | 2/1986 | Robison | 92/33 |
| 4,603,616 | 8/1986 | Zajac | 92/33 |

FOREIGN PATENT DOCUMENTS

| | | | |
|---|---|---|---|
| 244085 | 10/1969 | U.S.S.R. | 74/129 |

*Primary Examiner*—Charles A. Marmor
*Assistant Examiner*—Chong H. Kim
*Attorney, Agent, or Firm*—Oblon, Spivak, McClelland, Maier & Neustadt, P.C.

[57] ABSTRACT

A stepping actuator which is simple and compact in construction, and capable of converting rectilinear reciprocating motions into stepwise rotations of a predetermined stepping angle suitable for application of limited or limitless stepping rotations in one direction or in both forward and reverse directions. For these purposes, the stepping actuator is provided with at least one conversion mechanism for unidirectional stepping rotations, including: a rectilinearly reciprocating member 2 received in an outer frame 1 for axial back and forth movements therein; a rotating member 3 received in the rectilinearly reciprocating member 2 with an output shaft 4 led out axially through the outer frame 1; a circulative sunken track 11 formed on and around one of cylindrical surfaces at the interface between the outer frame 1 and the rectilinearly reciprocating member 2, and consisting of a large number of grooves 12 connected end to end in zigzag shape with inclinations alternately in opposite directions relative to the generator of the cylindrical surface; tracking projections 13 retained on the other cylindrical surface and resiliently pressed into the circulative sunken track 11 for travel therealong; and groove selector means in the form of a downwardly stepped surface provided contiguously to the tail end of each groove 12 of the sunken track 11, dropping the bottom surface of the sunken track to a lower level at the head end of a forwardly succeeding groove in the direction of circulation of the tracking projections, and urging the tracking projections 13 to select positively a forwardly succeeding groove when their travel direction is reversed at the connected ends of the grooves at the opposite sides of the sunken track 11 on reversals of the axial movements of the rectilinearly reciprocating member.

9 Claims, 11 Drawing Sheets

STEPPING ACTUATOR

This application is a Division of application Ser. No. 08/166,886, filed on Dec. 15, 1993, now abandoned.

BACKGROUND OF THE INVENTION

1. Field of the Art

Generally, for various purposes, many industrial machines are routinely required to make stepwise rotations of arbitrary stepping angles or to make arbitrary stepwise rotations in both forward and reverse directions.

This invention relates to a rotary stepping actuator which can meet such requirements by converting rectilinear reciprocating movements into stepwise or stepping rotations of an arbitrary number of steps, and more particularly to a rotary stepping actuator which is capable of converting rectilinear reciprocating movements into stepwise or stepping rotation advancing through a predetermined angle in each step, in such a way as to permit its application to those cases in need of stepwise rotations of an arbitrary number of steps in one direction or in both forward and reverse directions.

2. Description of the Prior Art

It has been the general practice in the art to resort to a servo motor in those cases where stepwise rotations of certain stepping angles are required or where stepwise rotations in both forward and reverse directions are required. However, the servo motors invariably necessitate to provide a control system which is complicate and very expensive, and even the mechanical type which is capable of rotations arbitrarily in both forward and reverse directions is relatively complicate in construction and control, let alone the problem that it is difficult to obtain large torques.

As a simpler means for obtaining stepwise rotations of a given stepping angle, there has thus far been known in the art a mechanism employing a rectilinearly reciprocating member and a rotating member which are coupled with each other in such a manner that an axial straight movement of the reciprocating member is converted into a certain angular rotation of the rotating member, by means of a helical groove provided on one of the two coupled members and a tracking projection provided on the other one of the coupled members in engagement with the helical groove thereby to convert axial reciprocating movements of the rectilinear drive member into alternate rotational movements of the rotating member which is in a restrained state in the axial direction.

Despite the advantage of simplicity in construction, what one can obtain from the mechanism of this sort as the output of the rotating member is simply rocking movements within a certain angular range, and it is difficult to obtain stepwise rotations consisting of a given number of steps in one direction or in both forward and reverse directions or to obtain infinite stepping rotations in a given direction.

SUMMARY OF THE INVENTION

It is a primary object of the present invention to provide a rotary stepping actuator which is inexpensive and simple and compact in construction similarly to the above-described mechanism using two members coupled with each other through a helical groove and a tracking projection, and yet which is capable of converting rectilinear reciprocating movements into stepwise rotations of a predetermined stepping angle in a manner suitable for application to operations requiring stepping rotations by a given number of steps or infinite stepping rotations in one direction.

It is another object of the present invention to provide a rotary stepping actuator capable of angular stepwise rotations of a given number of steps as well as infinite stepping rotations in one direction or selectively in both forward and reverse directions.

It is still another object of the present invention to provide a rotary stepping actuator which is simple in construction and stabilized in operation and which employs, for the above-mentioned stepwise rotations of a given number of steps as well as infinite rotations in one direction or in both forward and reverse directions, an endless circulative sunken track formed on and around a cylindrical surface and consisting of a multitude of grooves connected end to end in zigzag shape with inclinations alternately in opposite directions relative to the generator of the cylindrical surface, and tracking projections engaged in the circulative sunken track for travel therealong and guided to select a forwardly succeeding groove at the end of each groove where their travel direction is reversed in relation with back and forth axial movements of a rectilinearly reciprocating member.

It is still another object of the present invention to provide a rotary stepping actuator which is adapted to orient the tracking projections in the direction of the generator of the above-mentioned cylindrical surface, and to reverse their travel direction at outer connected ends of the grooves of the circulative sunken track of zigzag shape, thereby improving the positioning accuracy in each step of stepwise rotations.

It is a further object of the present invention to provide a rotary stepping actuator which can produce stepwise rotations of an arbitrary stepping angle in relation with back and forth axial movements of a rectilinearly reciprocating member.

It is a further object of the present invention to provide a rotary stepping actuator which is capable of producing stepwise rotations in both forward and reverse directions by the use of a couple of rectilinearly reciprocating members, employing a simple mechanism for positively urging the tracking projections to select a forwardly succeeding groove at each reversing point on circulative sunken tracks of forward and reverse drives.

According to the present invention, the above-stated objectives are achieved by the provision of a stepping actuator which is capable of converting axial back and forth movements of a rectilinearly reciprocating member into stepwise rotations of a rotating member advancing through a predetermined angle in each step.

More specifically, the stepping actuator according to the present invention is generally constituted by a rectilinearly reciprocating member received in an outer frame member, a drive means for driving the reciprocating member back and forth in the axial direction within the outer frame member, and a rotating member located coaxially within the rectilinearly reciprocating member and having an output shaft led out axially through the outer frame member. The stepping actuator is provided with at least a conversion mechanism for unidirectional stepping rotation on cylindrical surfaces at the interface between the rectilinearly reciprocating member and the outer frame member or the rotating member, the unidirectional conversion mechanism essentially including an endless circulative sunken track of zigzag shape formed on and around the circumference of one of the cylindrical surfaces and consisting of a series of grooves connected end to end in zigzag shape with inclinations alternately in opposite directions relative to the generator of the cylindrical surface, tracking projections retained on the other cylindrical surface and urged into engagement with the circulative sunken track, a groove selector mechanism provided contiguously to the tail end of each groove to let the tracking projections select a forwardly succeeding groove at each reversing point coinciding with the reversal of the axial movement of the reciprocating member. Where the unidirectional conversion mechanism is absent at the interface between the rectilinearly reciprocating member and the rotating member or the outer frame member, the two cylindrical surfaces are coupled with each other through a coupling means which blocks relative rotational movements of the two coupled members while permitting relative axial movements in a free state.

With the stepping actuator of the above-described construction, each one of the tracking projections is moved from the head to tail end of a groove as the reciprocating member is driven in an axial direction, thereby imparting a rotational movement to the rotating member through an angle, which is determined by the pitch of the grooves of the circulative sunken track, and the angular rotation is transmitted to the output shaft. Accordingly, it becomes possible to rotate the output shaft stepwise in one direction by driving the reciprocating member back and forth in the axial direction.

In case a unidirectional conversion mechanism is provided at the interface between the outer frame member and the reciprocating member in the above-described stepping actuator, it is possible to integrate the reciprocating member and the rotating member into one and single rotatable reciprocating member. In such a case, the output shaft produces composite movements which consist of a combination of axial reciprocating movements and stepwise rotational movements.

Further, in the above-described stepping actuator, it is possible to provide a couple of reciprocating members in axially aligned positions within the outer frame member for axial reciprocating movements independently of each other, in association with a common rotating member which is fitted axially into the two reciprocating members to produce selectively forward or reverse stepping rotations, transmitting to the output shaft stepping rotations of a required number of steps either in the forward or reverse direction. In this case, a unidirectional conversion mechanism is provided at the interface between the outer frame member and each one of the rectilinearly reciprocating members or at the interface between each one of the rectilinearly reciprocating member and the rotating member, the grooves of the circulative sunken track of each unidirectional conversion mechanism having a groove selector mechanism arranged inversely to the counterpart of the other unidirectional conversion mechanism in the direction of circulation of the tracking projections and being linked to an annular circumferential idling groove at their outer connected ends.

In driving operations by this stepping actuator, an angular rotation in a forward or reverse direction is imparted to the rotating member upon axially driving one of the rectilinearly reciprocating members and an angular rotation in the reverse direction is imparted to the rotating member upon driving the other one of the rectilinearly reciprocating member. In this case, as the rotating member is put in an angular rotation by an axial movement of one reciprocating member, the tracking projections in the grooves of the other reciprocating member are moved in an idling state along the annular circumferential groove, which is in communication with the outer connected ends of the respective grooves, so that stepping rotations either in a forward or reverse direction can be imparted to the rotating member selectively by either one of the reciprocating members although they are located in a tandem fashion on a single common axis in association with the forward and reverse unidirectional conversion mechanisms, respectively.

Accordingly, there can be obtained a rotary stepping actuator which is simple and compact in construction and low in cost and yet which is capable of producing arbitrary stepping rotations in forward and reverse directions as well as limitless or infinite stepping rotations in a given direction.

The constituent grooves of the above-described circulative sunken track are inclined alternately in opposite directions relative to the generator of the cylindrical surface and connected end to end in zigzag shape, so that the outer connected ends of adjacent grooves, where the tracking projections in the sunken track are turned to reverse their travel direction, contribute to enhance the positioning accuracy in each step of angular rotations.

Furthermore, in case of the stepping actuator which has a couple of rotating members aligned along a single common axis within the outer frame member for axial reciprocating movements independently of each other, it is possible to provide a unidirectional conversion mechanism at the interface between the outer frame member and each one of the axially reciprocating members and also at the interface between each one of the axially reciprocating members and the rotating member, arranging the groove selector mechanisms in the grooves of the unidirectional conversion mechanisms on the side of the outer frame member as well as the groove selector mechanisms in the grooves of the unidirectional conversion mechanisms on the side of the rotating member inversely to each other in the direction circulation of the tracking projections to use the two reciprocating members for forward and reverse drives, respectively. The circulative sunken tracks on the opposite sides of each reciprocating member may be arranged differently from each other in the direction of rotation and/or in the stepping angle, which is determined by the angle of inclination or pitch of the grooves in the respective circulative sunken tracks. In this case, the outer connected ends of the grooves in each circulative sunken track are linked to a circumferential idling groove formed around the cylindrical surface side by side with the sunken track.

Thus, by arranging the respective unidirectional conversion mechanisms inversely or differently in the direction of rotation and/or in the angle of stepping rotation in the above-described manner, it becomes possible to put the output shaft in stepping rotations in an arbitrary direction and over a wide range of stepping angles from a step of a relatively small angle to a step of a relatively large angle.

The groove selector mechanism in each of the above-described stepping actuator constructions can be constituted by a downwardly stepped surface which is provided between the tail end of each groove and the head end of a forwardly succeeding groove in the direction of circulation of the tracking projections in such a way that the bottom surface of the sunken track drops to a deeper level at the head end of the forwardly succeeding groove to be selected by the tracking projections which are resiliently pressed against the bottom surface of the circulative sunken track.

With the groove selector mechanism of this nature, the tracking projections are positively urged to select a forwardly succeeding groove in the direction of circulation when their travel direction is reversed in relation with the back and forth axial movements of the reciprocating member. As a result, axial back and forth movements of the rectilinearly reciprocating member are converted into unidirectional stepping rotations of the rotating member.

Alternatively, the above-mentioned groove selector mechanism may be constituted by a straight portion which is provided in a head end portion of each groove in the direction of the generator of the cylindrical surface continuously to the tail end of an adjacently preceding groove in the direction of circulation of the tracking projections. With this arrangement, the tracking projections are urged to select invariably a forwardly succeeding groove when their travel direction is reversed at the opposite sides of the circulative sunken track in relation with the back and forth axial movements of the rectilinearly reciprocating member.

In case a couple of reciprocating members are juxtaposed on a single common axis within the outer frame member for axial reciprocating movements indecently of each other, each one of the circulative sunken tracks, which are provided with a straight portion in a head end portion of each groove in the above-described manner, is preferably provided with a circumferential idling groove formed around the cylindrical surface in association with outer connected ends of the grooves and having recesses at spaced positions corresponding to straight head end portions of the grooves in the other circulative sunken track, the recesses being adapted to tentatively trap tracking projections while tracking projections in the other sunken track are running along the straight head end portions, thereby stabilizing the travel of the tracking projections along the straight head end portions in a more assured manner.

Moreover, in the above-described stepping actuator constructions, it is possible to use the outer frame member as a fluid cylinder for axially driving the reciprocating member or members or the rotatable reciprocating member, thereby applying a fluid pressure alternately to the opposite end faces of the reciprocating member or the rotatable reciprocating member which is slidably received in the outer frame as a piston. If desired, the fluid cylinder may be replaced by a solenoid-operated device or other mechanical drive means.

PARTICULAR DESCRIPTION OF THE INVENTION

Figure 1:
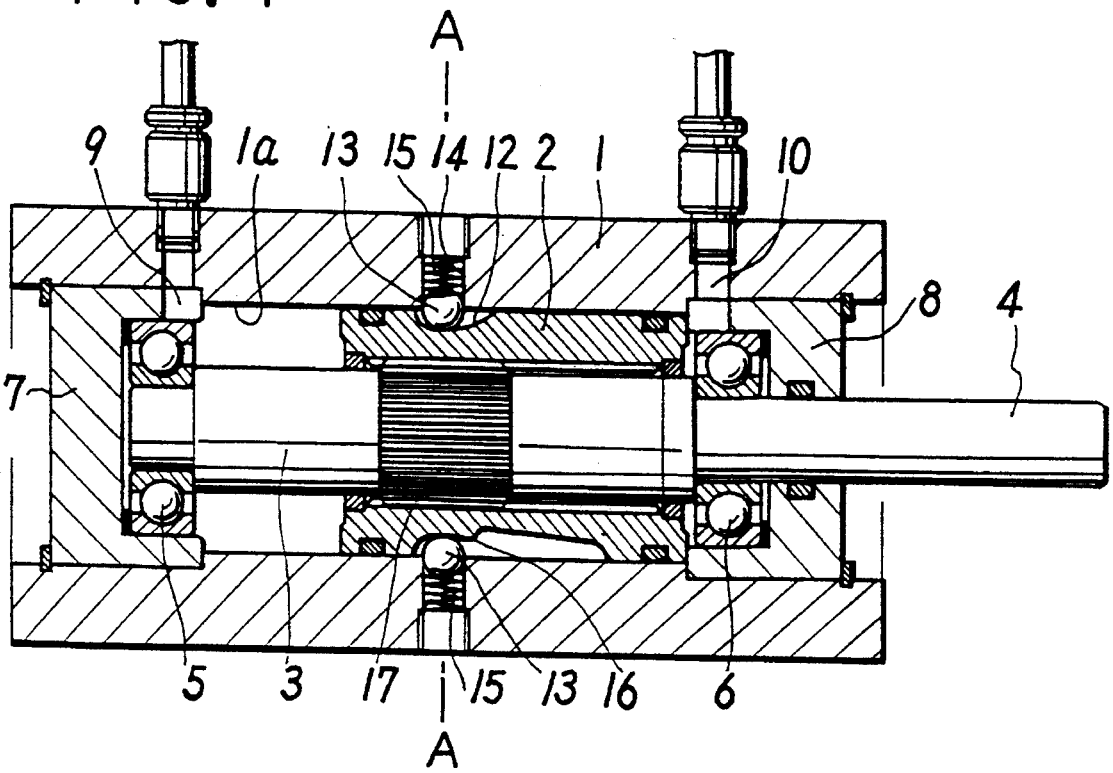
FIG. 1 is a longitudinal sectional view of a first embodiment of the invention.
Figure 2:
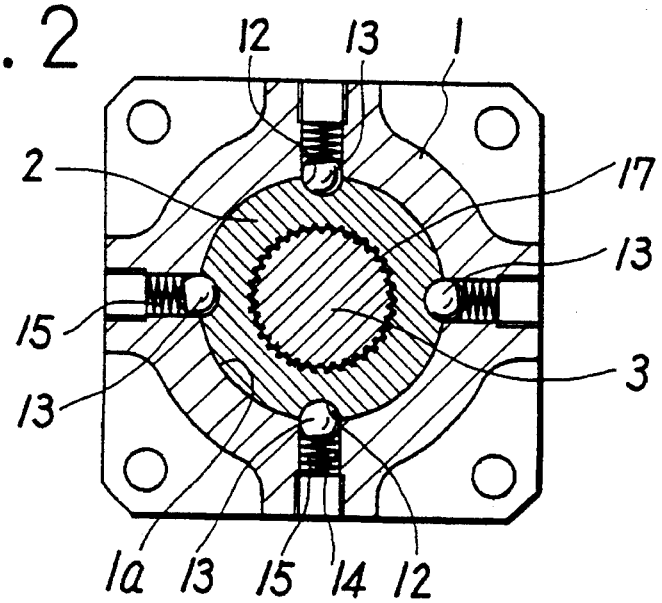
FIG. 2 is a transverse sectional view taken on line A—A of FIG. 1.
Figure 3:
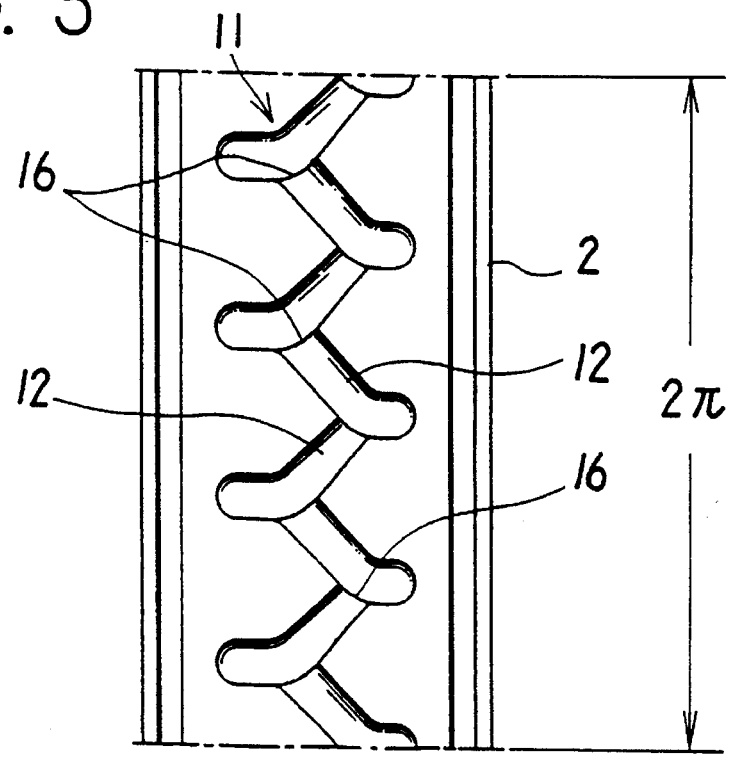
FIG. 3 is a developed view of a rectilinearly reciprocating member of the above-mentioned first embodiment, showing the shape of a series of grooves formed on its surface.

Referring first to FIGS. 1 to 3, there is illustrated a first embodiment of the stepping actuator according to the present invention.

This stepping actuator basically operates to convert a stroke of axial movement of a rectilinearly reciprocating member into a rotation through a predetermined angle of a rotating member, thereby producing unidirectional stepping rotations through an angle commensurate with the number of strokes of the rectilinearly reciprocating member at an output shaft which is connected to the rotating member. The stepping actuator further includes an outer frame member 1 to be mounted on a machine body for various purposes, the outer frame member 1 being internally provided with a cylindrical cavity 1*a* which receives therein a rectilinearly reciprocating member 2 of a cylindrical shape for axial sliding movements, along with a rotating member 3 which is located within the rectilinearly reciprocating member 2 and rotatably supported by bearings 5 and 6. The rotating member 3 is connected to an output shaft 4 which is axially led out through the outer frame member 1.

In this first embodiment, for driving the reciprocating member 2 back and forth in the axial direction, the opposite ends of the outer frame 1 are hermetically closed with covers 7 and 8 to serve as a fluid cylinder, and the reciprocating member 2 is slided as a piston within the air-tight cylindrical cavity 1*a* in the outer frame 1 by a fluid pressure (pneumatic or hydraulic pressure) which is supplied alternately through the ports 9 and 10 for application to the opposite end faces of the piston. In the respective embodiments which will be described hereinafter, the reciprocating member is arranged as a piston which is driven by fluid pressure in the same manner although not explained repeatedly in each case. However, in place of the fluid cylinder, the reciprocating member 2 may be coupled with a solenoid or other mechanical drive means if desired. The same applies to each of the embodiments which will be described later.

At the interface between the outer frame 1 and the reciprocating member 2, a large number of grooves 12 are formed in series on the cylindrical surface of the reciprocating member 2, the grooves 12 being inclined alternately in opposite directions relative to the generator of the cylindrical surface of the reciprocating member 2 as seen from its developed view of FIG. 3. These grooves 12 are connected end to end to form an endless circulative sunken track 11 of zigzag shape on and around the cylindrical circumferential surface of the reciprocating member 2. The grooves 12 have a predetermined depth as will be described hereinlater.

On the other hand, the outer frame member 1, which is held in sliding contact with the circumferential surface of the reciprocating member 2, is provided with tracking projections 13 which are resiliently pressed against the bottom surfaces of the grooves 12. Preferably, the tracking projections 13 are each constituted by a ball which is fitted in a radial hole 14 in the outer frame 1 and pushed inward from behind by a spring into pressed contact with one of the grooves 12. In this and following embodiments which employ a similar construction for the tracking projections, if desired, the balls exemplified in the drawings may be substituted by pins which are provided with a smooth semi-spherical surface at their projected inner ends.

Further, in place of the arrangement of this particular embodiment having the grooves 12 formed on the surface of the reciprocating member 2 for engagement with the tracking projections 13 which are protruded inward from the outer frame member 1 and resiliently pressed against the grooves 12, there may be employed a reversed arrangement having the grooves 12 on the inner surface of the outer frame member 1 and the tracking projections 13 on the part of the reciprocating member 2, if desired.

The outer connected end portions of the respective grooves 12 of the circulative sunken track 11 form reversing points for turning back the tracking projections 13 in the direction of the generator, and the provision of these reversing points contributes to improve the positioning accuracy in each step of stepwise rotations as will be described hereinafter.

In this stepping actuator, in order to put the rotating member in stepping rotations in one direction through back and forth axial movements of the reciprocating member 2, it is necessary for the tracking projections 13 to select and advance to a forwardly succeeding groove 12 at the reversing point at the end of each groove 12 shown in FIG. 3, without running back and forth on one particular groove 12 as their travel direction is reversed in relation with axial back and forth movements of the reciprocating member. For this purpose, a groove selector mechanism is provided on the grooves 12 for positively urging the tracking projections 13 to select a forwardly succeeding groove at the reversing point at the end of each groove on the reversal of the axial movement of the reciprocating member 2.

The above-mentioned groove selector mechanism can be realized in various forms and, in this particular embodiment, it is realized by the provision of a downward stepped surface 16 which is provided contiguously to the tail end of each groove 12 of the circulative track 11 (at a point a little short of the reversing point at the connected outer ends of two adjacent grooves). Namely, considering two adjacent grooves which are traced by the tracking projections on the forward and backward axial movements of the reciprocating member, for example, the circulative sunken track is deepened at the head end portion of a succeeding groove compared with the tail end portion of a preceding groove in the direction of circulation of the tacking projections 13. The lower half of the reciprocating member 2 in FIG. 1 is sectioned through tail and head ends of two adjacent grooves, showing the bottom surface profile of the sunken track including the stepped surface 16 of the groove selector mechanism.

The above-described stepped surface 16 at the tail end of each groove 12 ensures that each tracking projection 13 easily run onto a forwardly succeeding groove 12 at the reversing point where it starts a travel in a reverse direction along the succeeding groove in timed relation with the reversal of the axial movement of the reciprocating member 2. Since the tracking projections 13 are pressed against the bottom of the groove 12 by the springs 15, it can be urged onto a forwardly succeeding groove in an extremely assured manner. Thus, for the purpose of urging the tracking projections to select a forwardly succeeding groove irrevocably, the stepped surface 16 should have such a depth that the bottom surface of the circulative sunken track dips at the head end of the succeeding groove to a sufficient degree from the tail end of the preceding groove.

In order to let the tracking projections 13 select grooves 12 in forward positions successively in the above-described manner, each groove 12 which is deepened at its head end portion by the stepped surface 16 is profiled to become shallower gradually toward its tail end to lift up the tracking projection 13 to the original level.

With the above arrangement having the tracking projections 13 on the outer frame 1 pressed into the grooves 12 of the circulative sunken track 11 which is formed on the reciprocating member 2 with a downward stepped surface 16 at the tail end of each one of the grooves 12, axial back and forth movements of the reciprocating member 2 are converted into stepwise rotations in one direction. For the convenience of explanation, this mechanism is hereinafter referred to as "a unidirectional conversion mechanism".

More specifically, as the tracking projections 13 on the outer frame 1 are pressed into the alternately inclined grooves 12 on the reciprocating member 2, their positions in the rotational direction are restricted according to the axial position of the reciprocating member 2. Besides, the tracking projections 12 are guided by the stepped surfaces 16 to select invariably a forwardly succeeding groove at the reversing point at the end of each groove, so that the reciprocating member 2 is imparted with unidirectional stepping rotations as a result of its axial reciprocating movements.

The above-described reciprocating member 2 and the rotating member 3 are coupled with each other through a spline 17 which locks the two coupled members in the rotational direction for the transmission of rotation while permitting relative movements in the axial direction. This coupling means for the transmission of rotation is not limited to the spline shown, and instead there may be employed other coupling means. For example, axial grooves may be provided on one of the reciprocating member 2 and the rotating member 3 for engagement with projections which are provided on the other one. Alternatively, the reciprocating member 2 and the rotating member 3 may be coupled with each other through sliding surfaces of different sectional shapes or other suitable means including sliding keys or the like.

With the stepping actuator of the above-described construction, while the reciprocating member 2 is moved to the position of FIG. 1 from its left end position by the fluid pressure which is supplied through the port 9, each tracking projection 13 is shifted from the head to tail end of a groove 12 or from the right to left end of one of the grooves 12 shown in FIG. 3. Further, upon draining the fluid pressure through the port 9 and simultaneously supplying fluid pressure through the port 10, the reciprocating member 2 is moved to its left end position from the position shown in FIG. 1, and the tracking projection 13 is shifted from the left to right end of a forwardly succeeding groove 12 in FIG. 3 in a similar manner, thereby imparting the reciprocating member with a rotation through an angle which is determined by the shape or pitch of the grooves 12. This rotation of the reciprocating member 2 is transmitted to the rotating member 3 which is coupled with the output shaft 4.

In this instance, at the tail end of a groove 12, to be traced on a forward axial movement of the reciprocating member, the bottom surface of the circulative sunken track drops across the stepped surface onto a deepened head end portion of a forwardly succeeding groove, to be traced on the following backward axial movement of the reciprocating member 2, thereby letting each tracking projection 13 invariably select a succeeding groove in a stabilized state at the reversing point at the end of each groove. Therefore, unidirectional stepping rotations can be imparted to the reciprocating member 2 in a reliable manner as a result of its axial reciprocating movement.

Figure 4:
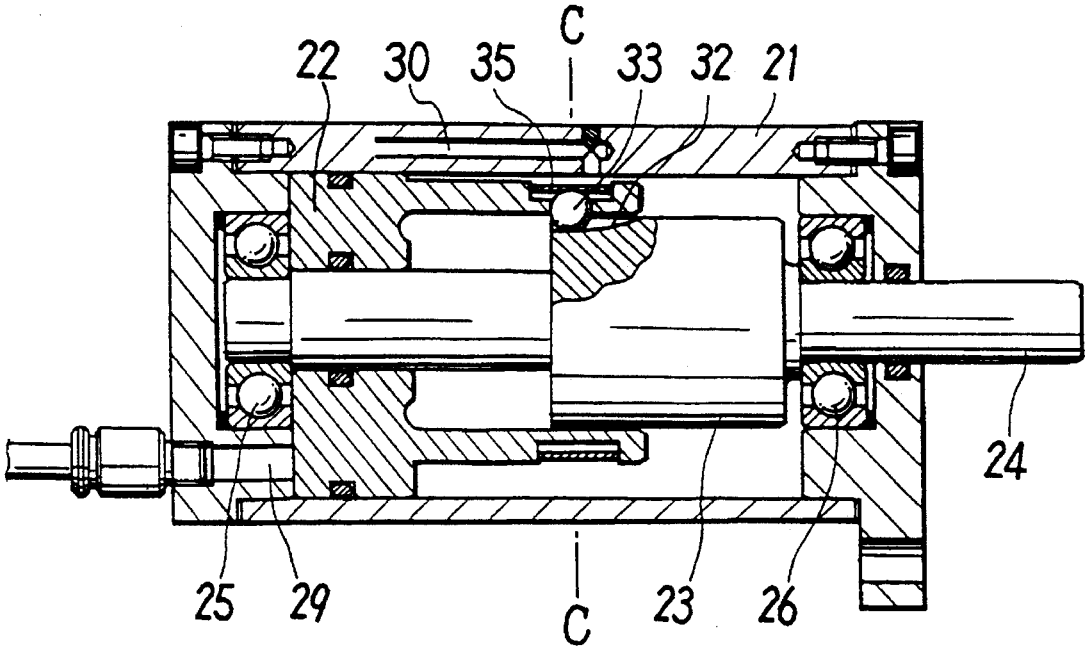
FIG. 4 is a longitudinal sectional view of a second embodiment of the invention, taken on line B—B of FIG. 5.
Figure 5:
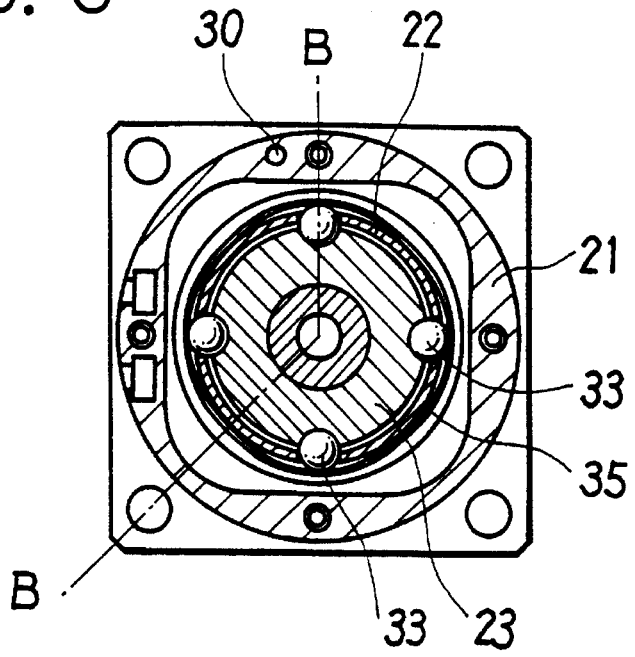
FIG. 5 is a transverse sectional view taken on line C—C of FIG. 4.
Figure 6:
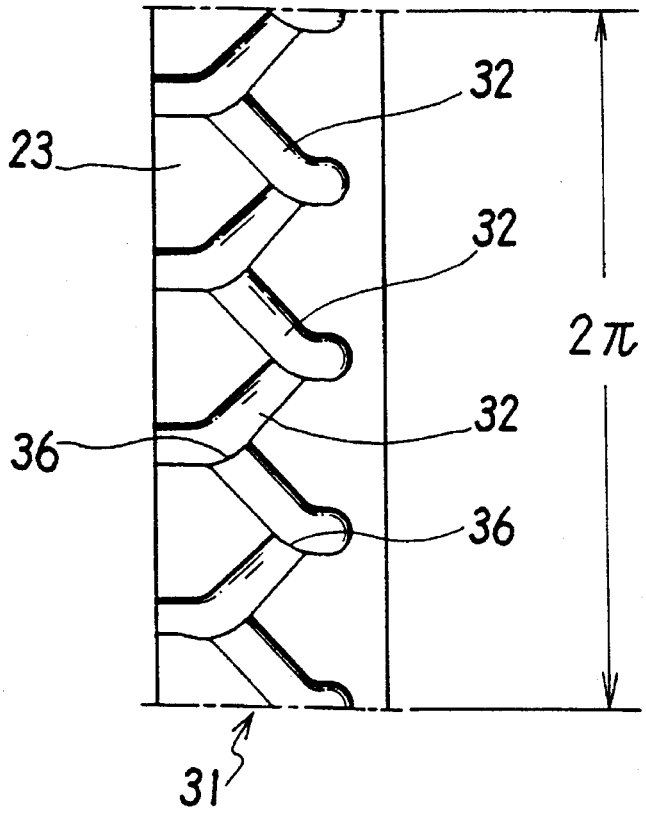
FIG. 6 is a developed view of a rotating member in the second embodiment, showing the shape of a series of grooves formed on its surface.

Illustrated in FIGS. 4 to 6 is a second embodiment of the present invention. In the same manner as in the above-described first embodiment, the stepping actuator of this second embodiment has a reciprocating member 22 slidably fitted in an outer frame 21 for axial reciprocating movements therein, and has a rotating member 23 located on the inner side of the reciprocating member 22, the rotating member 23 being rotatably supported by bearings 25 and 26 and coupled with an output shaft 24 which is axially led out through the outer frame 21. The reciprocating member 22 is axially driven back and forth by fluid pressure (pneumatic or hydraulic pressure) which is alternately supplied and drained to and from a couple of ports 29 and 30. In this case, however, a conversion mechanism for unidirectional stepping rotations is provided not at the interface between the reciprocating member 22 and the outer frame 21 but on cylindrical sliding surfaces at the interface between the reciprocating member 22 and the rotating member 23.

This unidirectional conversion mechanism is basically same as in the first embodiment in construction. Namely, as seen in the developed view of FIG. 6, the rotating member 23 is provided with, on its cylindrical circumferential surface, a series of grooves 32 which are inclined alternately in opposite directions with respect to the generator of the cylindrical surface. These grooves 32 are successively connected end to end in zigzag shape to provide an endless circulative sunken track 31 to receive ball-like tracking projections 33 which are resiliently pressed into the sunken track 31 by an annular spring 35 located around the respective tracking projections 33. In order to let the tracking projections 33 select a forwardly succeeding groove, the circulative sunken track 31 is provided with the same groove selector mechanism as in the first embodiment, i.e., a stepped surface 36 which is formed across the tail and head ends of two adjacent grooves 32.

If desired, the positions of the grooves 32 and the tracking projections 33 may be switched, providing the grooves 32 on the side of the reciprocating member 22 and mounting the tracking projections 33 on the surface of the rotating member 23 in such a way that they are resiliently pressed into the grooves 32 on the reciprocating member 22.

Further, for the purpose of blocking relative rotational movements of the reciprocating member 22 and the outer frame 21, their sliding surfaces are formed in different sectional shapes as shown particularly in FIG. 5. However, it is possible to employ various mechanisms for this purpose, as described hereinbefore in connection with the coupling means between the reciprocating member 2 and the rotating member 3 of the first embodiment.

In the stepping actuator of the second embodiment with the above-described construction, as the reciprocating member 22 is moved to its right end position from its left end position shown in FIG. 4 by the fluid pressure supplied to the port 29, its rotation is blocked by the outer frame 21, and the tracking projections 33 are each moved along one of the grooves 32 on the rotating member 23 to impart rotation thereto. Then, while the reciprocating member 22 is moved backward or toward the left end position of FIG. 4 by the fluid pressure supplied to the other port, the tracking projections 33 are similarly moved along the grooves 32 in the reverse direction on the rotating member 23 to impart again an angular rotation thereto. Consequently, through the rotating member 23, axial back and forth movements of the reciprocating member are converted into stepping rotations of the output shaft 24 with a stepping angle which is determined by the pitch of the grooves 32.

In this instance, the bottom surface of the sunken track 31 likewise drops to a lower level across the stepped surface 36, more specifically from the tail end of each groove 32 (e.g., a groove to be traced on a forward axial movement of the reciprocating member 22) to the deepened head end portion of a forwardly succeeding groove 32 (e.g., a groove to be traced on a backward axial movement of the reciprocating member 22), so that the tracking projections 33 successively select a forwardly succeeding groove in a stabilized state at the respective reversing points to impart unidirectional stepping rotations to the rotating member in a reliable manner.

Figure 7:
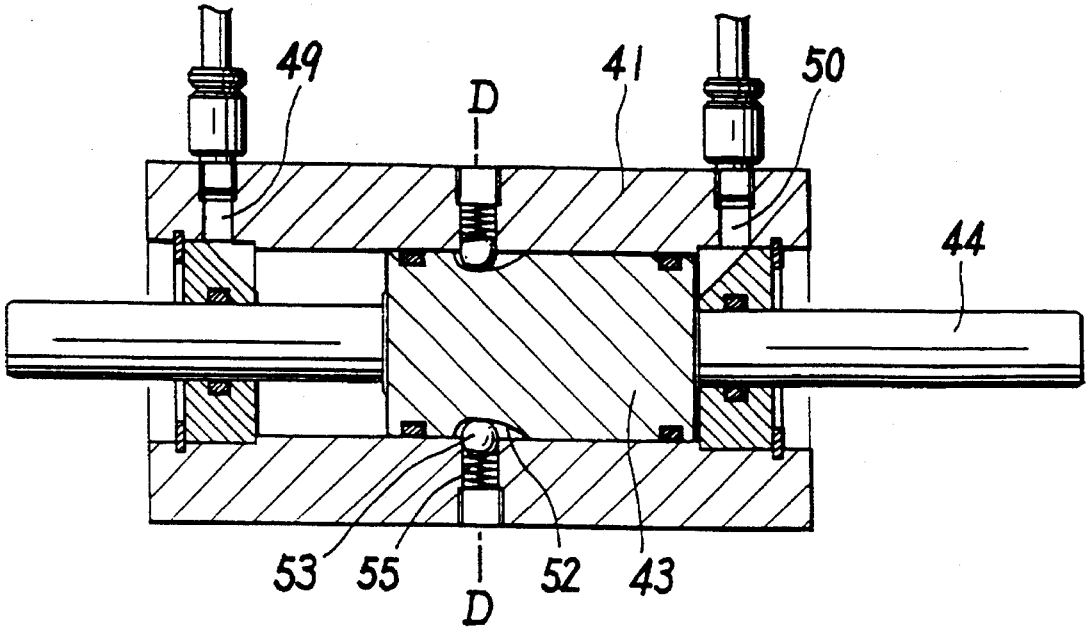
FIG. 7 is a longitudinal sectional view of a third embodiment of the invention.
Figure 8:
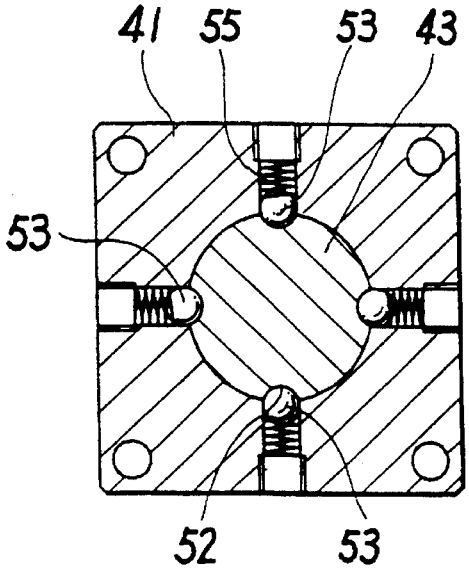
FIG. 8 is a transverse sectional view taken on line D—D of FIG. 7.

Illustrated in FIGS. 7 and 8 is a third embodiment of the present invention, in which the reciprocating member 2 and the rotating member 3 is integrated into one rotatable reciprocating member 43.

More specifically, in this third embodiment, the above-mentioned rotatable reciprocating member 43 is accommodated in an outer frame 41 with a couple of ports 49 and 50 through which a fluid pressure is supplied and discharged to drive the reciprocating member 43 back and forth in the axial direction. The rotatable reciprocating member 43 is connected to an output shaft 44 which is axially led out of the outer frame 41. A conversion mechanism for unidirectional rotation, including a circulative sunken track which consists of a series of grooves 52 and tracking projections 53 which are resiliently pressed into the grooves 52 by springs 55, is provided on cylindrical sliding surfaces at the interface between the rotatable reciprocating member 43 and the outer frame member 41.

The grooves 52 on the rotatable reciprocating member 43 and the stepped surface portions at the tail ends of these grooves 52 are arranged in the same manner as in FIG. 3.

In this embodiment, the rectilinearly reciprocating member and the rotating member are integrated into one body as mentioned hereinbefore, so that, when fluid pressure is supplied alternately to the ports 49 and 50, the output shaft 44 which is connected to the rotatable reciprocating member 43 produces composite motions, i.e., a combination of unidirectional stepping rotations and axial reciprocating movements, which can be advantageously used in certain cases.

Figure 9:
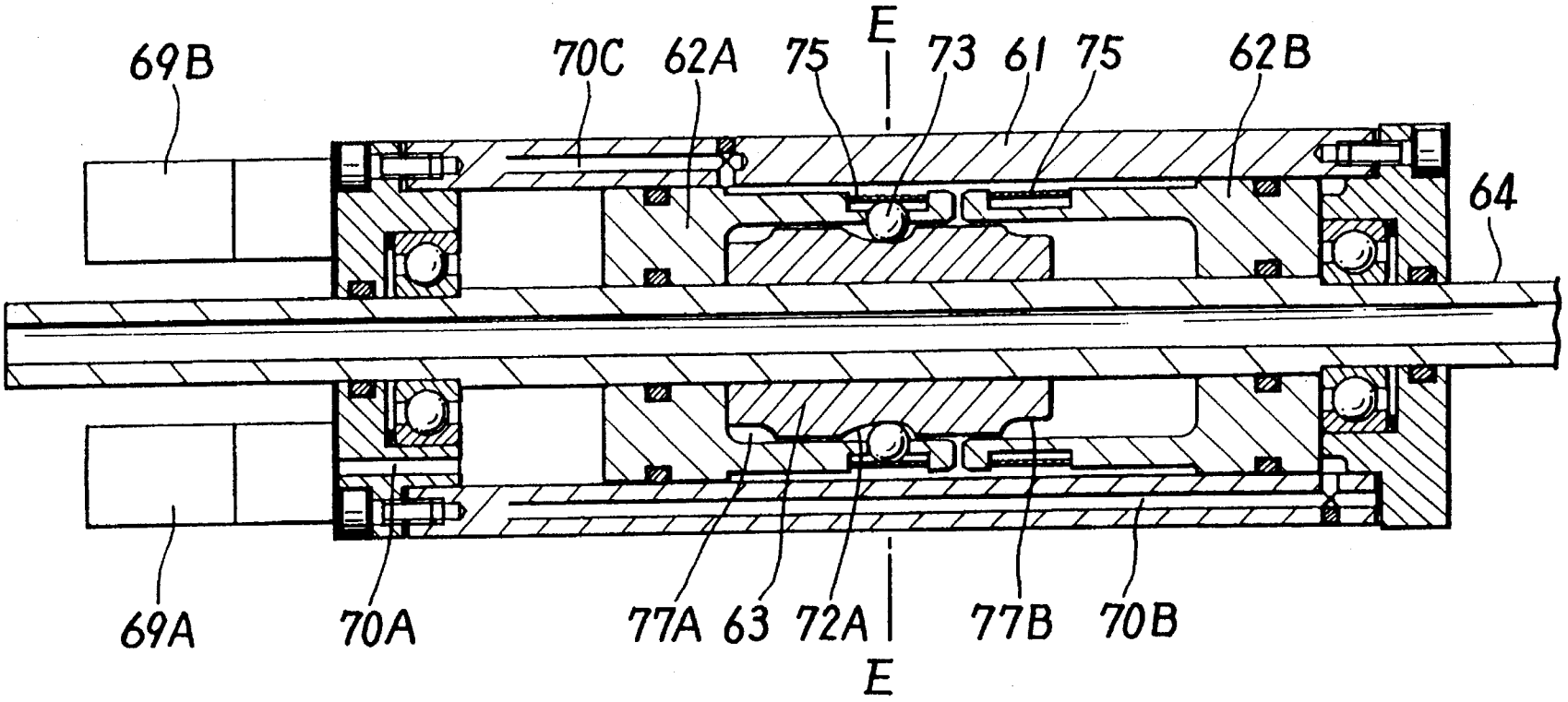
FIG. 9 is a longitudinal sectional view of a fourth embodiment of the invention.
Figure 10:
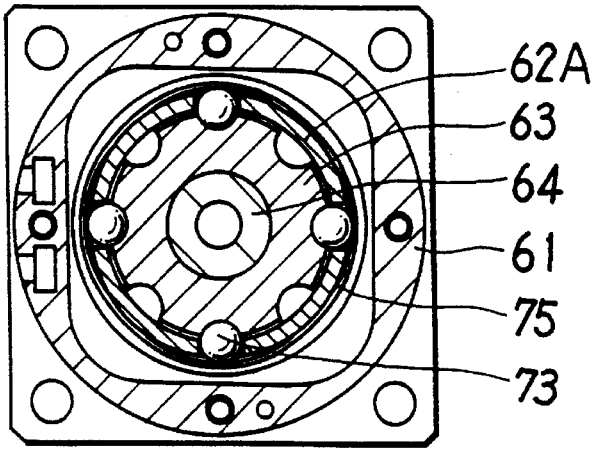
FIG. 10 is a transverse sectional view taken on line E—E of FIG. 9.
Figure 11:
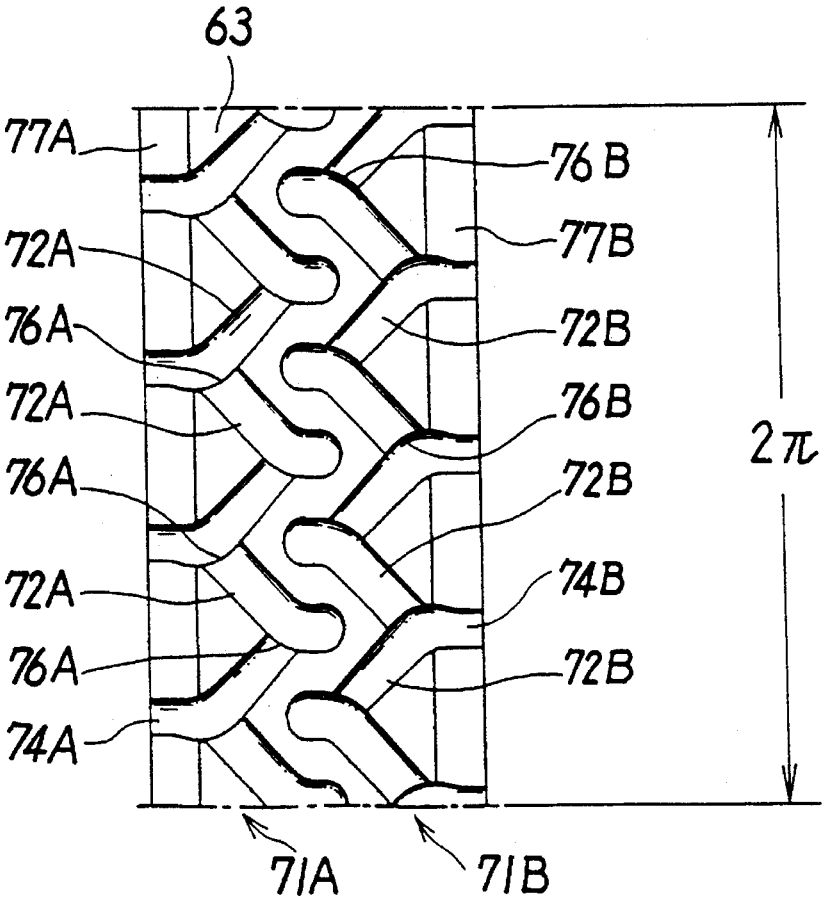
FIG. 11 is a developed view of a rotating member in the fourth embodiment, showing the shape of a series of grooves formed on its surface.

Illustrated in FIGS. 9 to 11 is a fourth embodiment of the invention, employing a couple of reciprocating members which are juxtaposed in the axial direction to provide a couple of unidirectional conversion mechanisms for forward and reverse drives, respectively.

More specifically, in this fourth embodiments, a couple of rectilinearly reciprocating members 62A and 62B, which are driven independently of each other, are slidably juxtaposed in the axial direction within an outer frame member 61 in such a manner as to block relative rotational movements by the use of different sectional shapes. Rotatably fitted in these rectilinearly reciprocating members 62A and 63B is a common rotating member 63 which has its output shaft 64 axially led out through the outer frame member 61. The outer frame 61 and each of the reciprocating members 62A and 62B are blocked against relative rotational movements by the above-described blocking means or by other suitable means.

A fluid pressure (pneumatic or hydraulic pressure) is selectively applied to the outer end face of either the reciprocating member 62A or 62B through a solenoid valve 69A, which is mounted on the outer frame 61, and through a fluid passage 70A or 70B thereby to move the reciprocating member 62A or 62B axially inward. Upon draining the fluid pressure from the outer end face, the fluid pressure is simultaneously supplied between the two reciprocating members 62A and 62B by a solenoid valve 69B through a fluid passage 70C to return the reciprocating member 62A or 62B to the outer position in the outer frame 61.

As shown particularly in FIG. 11, two rows of grooves 72A and 72B, similar to those in the above-described second embodiment, are formed on the circumferential surface of the rotating member 63 to provide circulative sunken tracks 71A and 71B for a couple of unidirectional rotation conversion mechanisms. These circulative sunken tracks 71A and 71B receive therein tracking projections 73 which are retained on the opposing reciprocating members 62A and 62B and resiliently pressed against the respective tracks by springs 75. Each of the grooves 72A and 72B has its tail end portion connected to a head end portion of a forwardly succeeding groove through a downward stepped surface 76A or 76B to let each of the tracking projections 73 invariably select the deepened head portion of a forwardly succeeding groove when its travel direction is reversed at the reversing point past the tail end of each groove. More specifically, the grooves 72A and 72B of the circulative sunken tracks 71A and 71B are provided with groove selector mechanisms which are arranged inversely to each other in the direction of circulation of the tracking projections 73, causing the tracking projections 73 in the sunken tracks 71A and 71B to select grooves in the opposite directions at the respective reversing points. Therefore, the conversion mechanisms on the reciprocating members 62A and 62B can serve as conversion mechanisms for forward and reverse drives, respectively.

Further, while one rectilinearly reciprocating member 62A or 62B is in operation to impart rotation to the rotating member 63, the other reciprocating member 62B or 62A should be left rotatable relative to the rotating member 63. For this purpose, the outer ends of the grooves 72A and 72B are connected to circumferential idling grooves 77A and 77B, respectively. These circumferential idling grooves 77A and 77B are formed shallower than the outer connected ends of the grooves 72A and 72B, so that they have no possibility of impairing the function of punctuating the rotation at the respective stepping positions (i.e., the function of determining the angular positions) by the connected outer ends of the grooves.

In a driving operation by the stepping actuator of the above-described construction, a fluid pressure is selectively applied to the outer end face of one reciprocating member 62A or 62B through the fluid passage 70A or 70B by a switching operation of the solenoid valve 69A, thereby to move the reciprocating member axially inward. Upon draining the fluid pressure from the outer end face, the fluid pressure is simultaneously supplied to a fluid chamber between the two reciprocating members 62A and 62B by the solenoid valve 69B through the fluid passage 70C, whereupon the reciprocating member 62A or 62B is moved inward to return to its outer position. As a result of this axial reciprocating movement, angular stepping rotations in the forward or reverse direction are imparted to the rotating member 63.

In this instance, for example, when the rotating member 63 is rotationally driven by an inward axial movement of the reciprocating member 62A through the unidirectional conversion mechanism, it is necessary to relieve the rotating member 63 of the restraining actions of the tracking projections 73 which are protruded into the grooves 72B from the other reciprocating member 62B, which is blocked against rotation relative to the outer frame 61. To this end, the circumferential idling grooves 77A and 77B are formed around the opposite ends of the rotating member 63 in association with the connected outer ends of the grooves 72A and 72B, permitting the tracking projections 73 to run therealong in an idling state when not in operation. Accordingly, the rotating member 63 can be arbitrarily imparted with stepping rotations in the forward or reverse direction in relation with the axial back and forth movements of the reciprocating member 62A or 62B.

The circumferential grooves 77A and 77B are likewise formed shallower than the outer ends 74A and 74B of the grooves 72A and 72B as mentioned hereinbefore, so that the tracking projections 73 running out onto the circumferential idling groove 77A or 77B tend to settle into the deeper outer end portions 74A or 74B of the grooves 72A or 72B, assuming their positions on the grooves 72A or 72B in a stabilized manner.

In the above-described fourth embodiment, the rectilinearly reciprocating members 62A and 62B are coupled with the outer frame member 61 through sectional shapes which block relative rotational movements. However, this arrangement may be substituted with other rotation blocking means, for example, by eccentric positioning of the rectilinearly reciprocating members relative to the outer frame member 61 in combination with eccentric positioning of the rotating member relative to the rectilinearly reciprocating members 62A and 62B.

Figure 12:
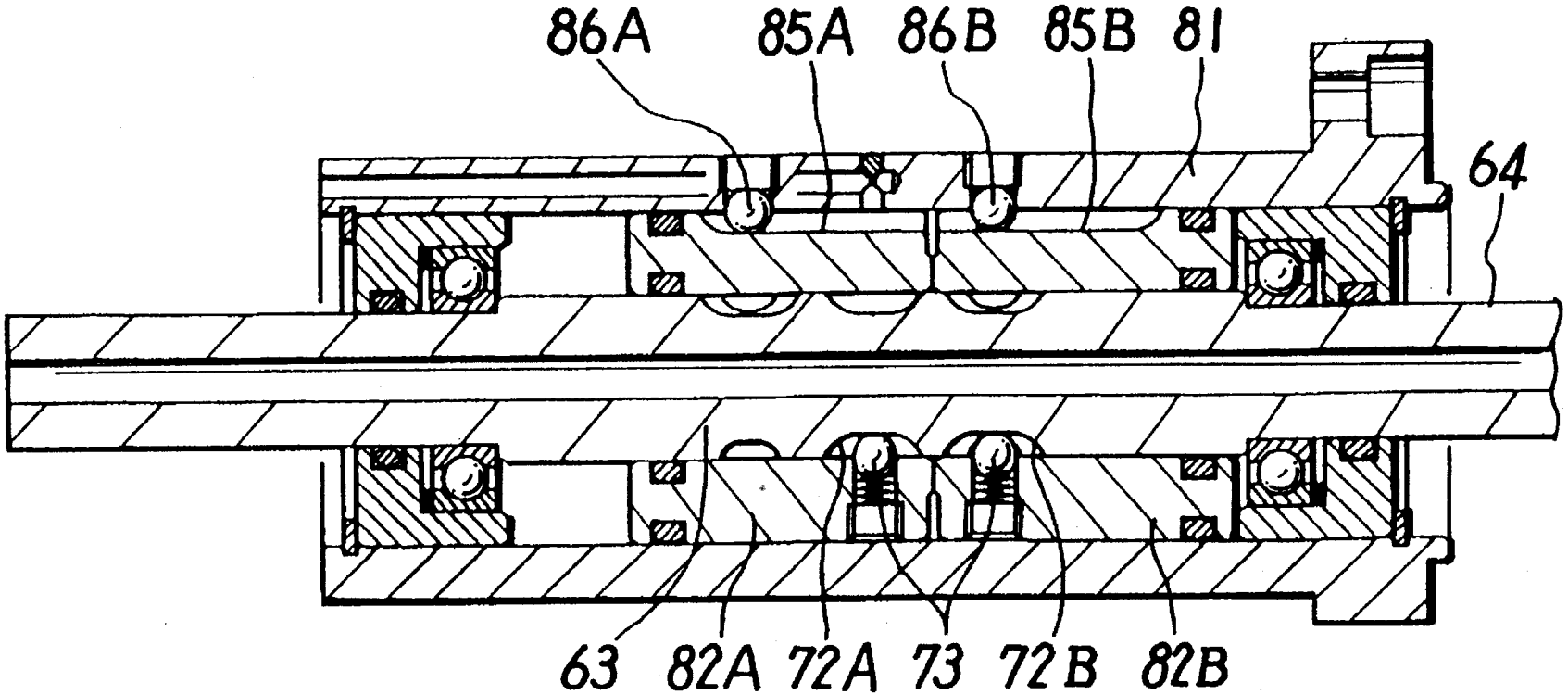
FIG. 12 is a longitudinal sectional view of a fifth embodiment of the invention.

Illustrated in FIG. 12 is a fifth embodiment of the invention, which employs a coupling means different from the one shown in the foregoing fourth embodiment, for blocking rotational movements of the rectilinearly reciprocating members relative to the outer frame member.

In this fifth embodiment, a couple of reciprocating members 82A and 82B are axially slidably fitted in an outer frame 81 for axial reciprocating movements independently of each other, For the purpose of blocking relative rotational movements, the axially reciprocating members 82A and 82B are provided with axial guide grooves 85A and 85B, respectively, for engagement with balls 86A and 86B which are retained in ball nesting holes on the part of the outer frame member 81.

In this embodiment, except the rotation blocking means, the stepping actuator is arranged in the same manner as in the foregoing fourth embodiment. Therefore, its major component parts are designated by references which are common with the fourth embodiment, and their explanations are omitted to avoid repetitions.

Figure 13:
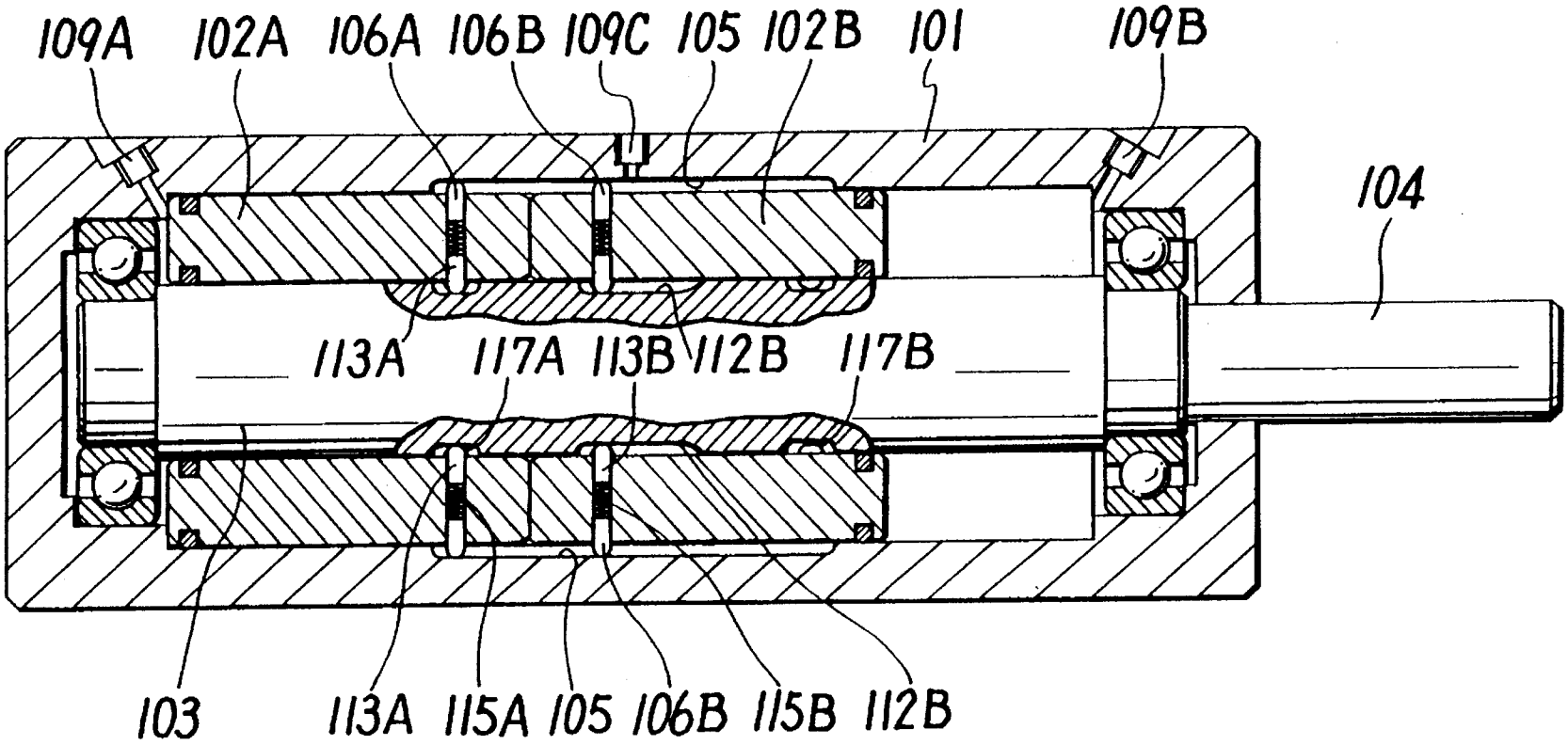
FIG. 13 is a longitudinal sectional view of a sixth embodiment of the invention, taken on line F—F of FIG. 14.
Figure 14:
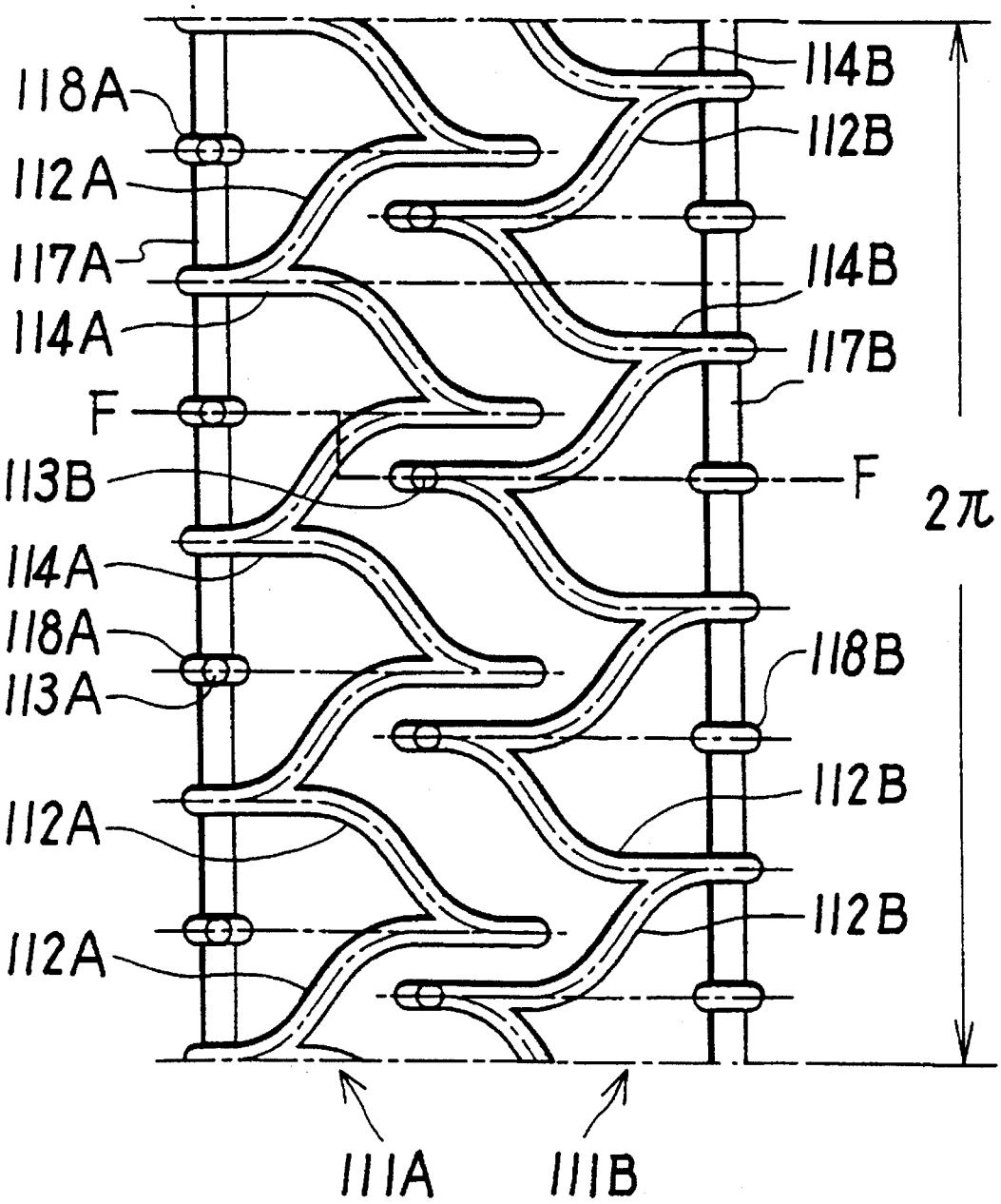
FIG. 14 is a developed view of a rotating member in the sixth embodiment, showing the shape of a series of grooves formed on its surface.

Illustrated in FIGS. 13 and 14 is a sixth embodiment of the invention, which functions in a manner similar to the fourth embodiment of FIGS. 9 to 11 and the fifth embodiment of FIG. 12 but which employs a different groove selector mechanism.

More specifically, the stepping actuator according to this sixth embodiment includes a couple of rectilinearly reciprocating members 102A and 102B which are slidably received in an outer frame member 101 for axial reciprocating movements independently of each other, and a common rotating member 103 which is rotatably supported through the reciprocating members with its output shaft axially led out through the outer frame member 101. As means for blocking rotational movements of the reciprocating members 102A and 102B relative to the outer frame 101, axial guide grooves 105 are formed on the inner periphery of the outer frame 101 in engagement with pin members 106A and 106B which are radially projected from the reciprocating members 102A and 102B.

Similarly to the foregoing fourth embodiment, the outer frame 101 is provided with ports 109A, 109B and 109C to which a fluid pressure (pneumatic or hydraulic pressure) is selectively supplied to drive the reciprocating member 102A or 102B back and forth in the axial direction.

Provided at the interfaces of the two reciprocating members 102A and 102B with the rotating member 103 are a couple of unidirectional conversion mechanisms including: circulative sunken tracks 111A and 111B which are formed on and around the circumferential surface of the rotating member 103; pin-like tracking projections 113A and 113B which are fitted in the same pin-nesting holes as the aforementioned pins 106A and 106B; springs 115A and 115B which are interposed between the pins 106A or 106B and the tracking projections 113A or 113B to resiliently urge these pins and tracking projections in radially outward and inward directions, respectively. The circulative sunken tracks 111A and 111B are each constituted by a large number of grooves 112A or 112B which are inclined alternately in opposite directions relative to the generator and connected to adjacent grooves end to end to form an endless sunken track of zigzag shape. The outer connected ends of the grooves 112A and 112B in the sunken tracks 111A and 111B are connected to circumferential idling grooves 117A and 117B, respectively.

The groove selector mechanism of this sixth embodiment includes straight portions 114A and 114B which are provided in the direction of the generator of the cylindrical circumferential surface and in head end portions of the grooves 112A and 112B of the circulative sunken tracks 111A and 111B. Namely, the tail end of each of the grooves 112A and 112B of the circulative sunken tracks 111A and 111B is connected to a straight head end portion of a forwardly adjacent groove in the direction of circulation as indicated at 114A or 114B. With this arrangement, as the tracking projections 113A or 113B are reversed at the opposite ends of the grooves 112A or 112B in relation with the axial back and forth movements of the reciprocating member 102A or 102B, they tend to move inward rectilinearly, automatically and successively selecting a straight head end portion of a forwardly succeeding groove in the direction of circulation.

The groove selector mechanism of the above-described arrangement can be employed in any other embodiment of the invention if desired.

In case a couple of reciprocating members 102A and 102B, with unidirectional conversion mechanisms for forward and reverse drives, are juxtaposed in the axial direction in the manner as in this sixth embodiment, it is desirable to employ a groove selector mechanism which includes, in addition to the above-described straight portions 114A and 114B, recesses 118A and 118B on the circumferential idling grooves 117A and 117B for the purpose of stabilizing the travel of the tracking projections 113A and 113B as they run along a straight portion 114A or 114B, and for permitting the tracking projections 113A and 113B to select a forwardly succeeding groove in a stabilized state.

More specifically, during the time period when the tracking projections 113B are running along the straight portions 114B in the circulative sunken track 111B (i.e., when the rotating member 103 is retained at a certain angular position), the tracking projections in the other circulative sunken track 111A are tentatively trapped in the recesses 118A in the circumferential idling groove 117A, which is in communication with the outer ends of the grooves of the sunken track 111A, for the purpose of stabilizing the travel of the tracking projections 113B along the straight portions 114B. Similar recesses 118B are provided in the circumferential groove 117B which is in communication with the outer connected ends of the grooves of the circulative sunken track 111B. The groove selector mechanism of this arrangement also can let the tracking projections successively select a groove in a forward position in the direction of circulation in a more stabilized state.

Figure 15:
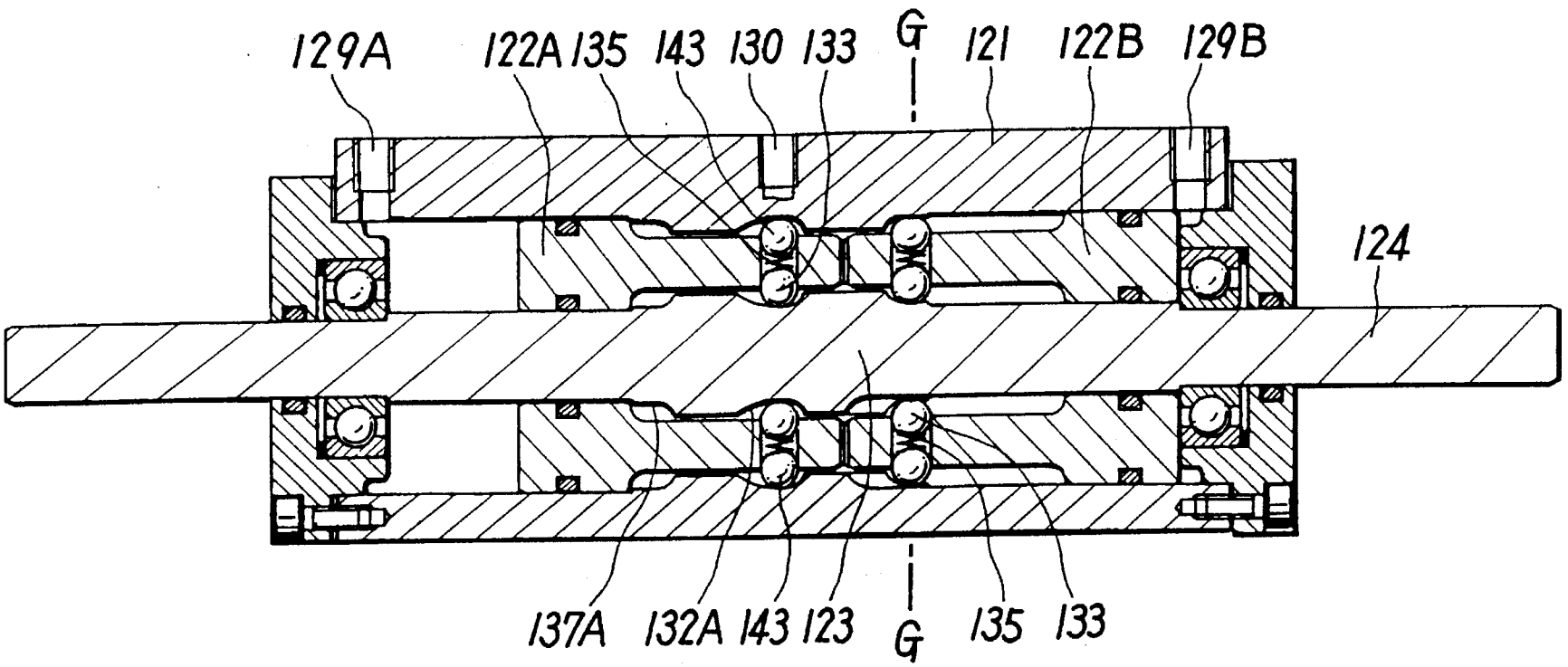
FIG. 15 is a longitudinal sectional view of a seventh embodiment of the invention.
Figure 16:
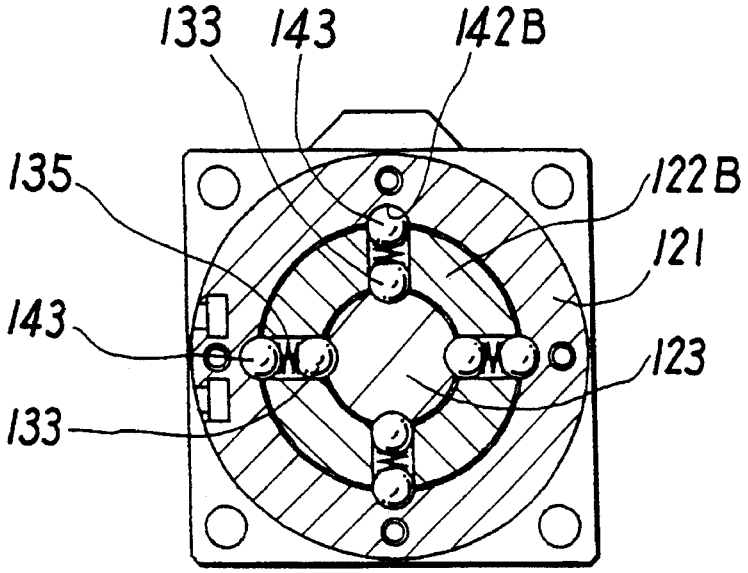
FIG. 16 is a transverse sectional view taken on line G—G of FIG. 15.
Figure 17:
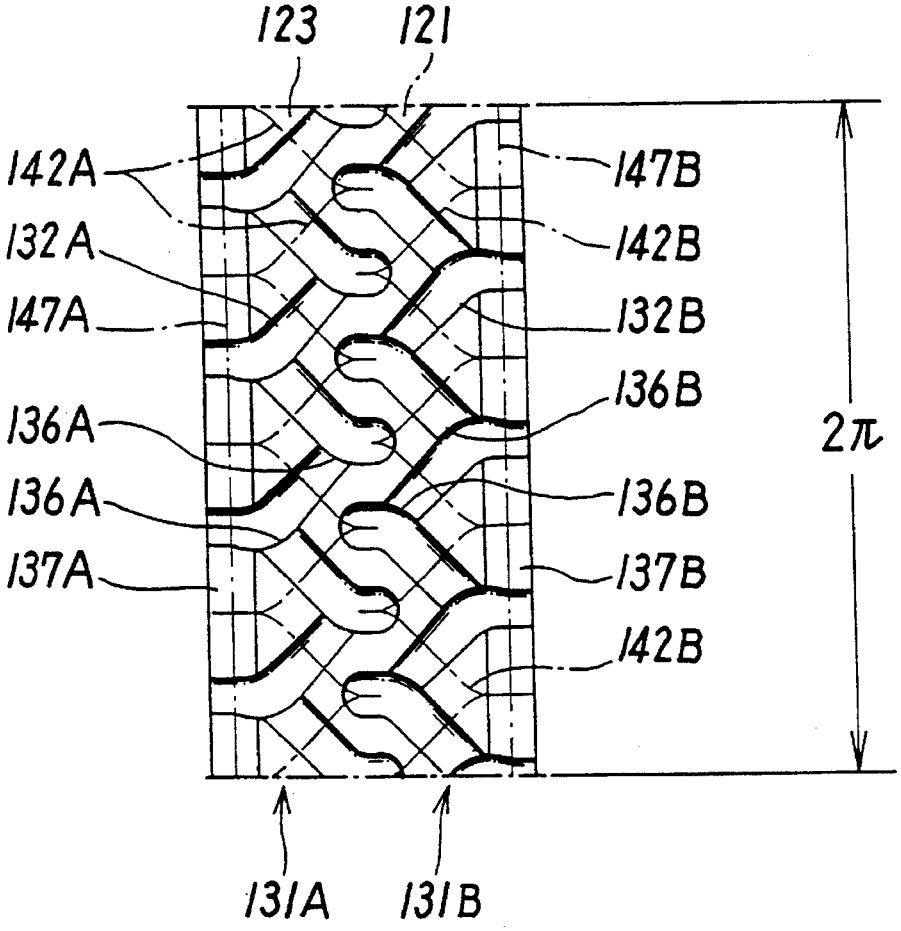
FIG. 17 is a developed view of a rotating member in the seventh embodiment, showing the shape of a series of grooves formed on its surface along with the shape of grooves on the inner surface of an outer frame member.

Illustrated in FIGS. 15 to 17 is a stepping actuator in a seventh embodiment according to the invention, which has a couple of rectilinearly reciprocating members 122A and 122B in axially aligned positions to provide a couple of unidirectional conversion mechanisms in cooperation with a common rotating member 123, the reciprocating members 122A and 122B being axially movable independently of each other to put the rotating member 123 in stepwise rotations either in the forward or reverse direction in the same manner as in the foregoing fourth to sixth embodiments. In this case, the actuator employs additional unidirectional conversion mechanisms in place of the coupling means which is employed in the foregoing embodiments for blocking rotational movements of the reciprocating members relative to the outer frame. In order to realize stepwise rotations of a broader stepping angle range in an arbitrary direction, the additional or second unidirectional conversion mechanisms to be provided in association with the respective reciprocating members may be of a different rotational direction and/or of a different stepping angle from the unidirectional conversion mechanism between the corresponding reciprocating member and the rotating member.

More specifically, the stepping actuator of this embodiment is provided with; a couple of reciprocating members 122A and 122B which are slidably received in an outer frame 121 for axial reciprocating movements independently of each other; and a single rotating member 133 which is rotatably supported within the outer frame 121 through the reciprocating members 122A and 122B and has its output shaft 124 led out axially through the outer frame 121. In operation, either the reciprocating member 122A or 122B is moved axially inward by a fluid pressure which is selectively applied to its outer end face through a port 129A or 129B in the outer frame 121, and axially moved backward by a fluid pressure which is supplied between the two reciprocating members 122A and 122B concurrently with draining of the fluid pressure from the outer end face.

Formed on the circumferential surface of the rotating member 123 are two rows of grooves 132A and 132B which are inclined alternately in opposite directions as shown in FIG. 17 in a manner similar to the foregoing fourth embodiment. Both of the grooves 132A and 132B have their opposite ends connected to adjacent grooves end to end in zigzag shape to provide a pair of endless circulative sunken tracks 131A and 131B around the circumference of the rotating member 123. Tracking projections 133 which are retained on the reciprocating members 122A and 122B are resiliently pressed against the bottom surfaces of the circulative sunken tracks 131A and 131B. As a groove selector mechanism, the above-mentioned grooves 132A and 132B, which are connected tail to head, are provided with a stepped surface between the tail and head ends of adjacently connected grooves in such a way that the bottom surface of the grooves sinks to a deeper level at the head end of a forwardly succeeding groove which is located in a forward position in the direction of circulation of the tacking projections 133, thereby letting the tracking projections 133 invariably select a forwardly located groove at the reversing points at the ends of the respective grooves 132A and 132B. The groove selector mechanisms in the grooves 132A and 132B are arranged inversely to each other in the direction of circulation of the tracking projections 133, so that the reciprocating members 122A and 122B can operate as forward and reverse drives, respectively.

Further, the outer connected ends of the grooves 132A and 132B in the first unidirectional conversion mechanisms are connected to the circumferential idling grooves 137A and 137B, respectively. These circumferential idling grooves 137A and 137B are formed shallower than the connected outer ends of the grooves 132A and 132B to secure the function of controlling the stepping positions (or angular positions) by the latter in cooperation with the tracking projections.

In this embodiment, the outer frame 121 is also provided with two rows of zigzag grooves 142A and 142B on its inner peripheral surface. As seen in FIG. 17 which indicates the center lines of the grooves 142A and 142B by chain lines, these grooves 142A and 142B are inclined alternately in opposite directions to form endless circulative sunken tracks 141A and 141B for the second unidirectional conversion mechanisms similar to the above-described first mechanisms. Tracking projections 143 which are retained on the reciprocating members 122A and 122B are resiliently pressed against the bottom surfaces of these circulative sunken tracks 141A and 141B, respectively. In the same manner as in the case of the grooves on the rotating member, the grooves 142A and 142B are provided with a stepped surface (not shown) between the tail end of each groove and the head end of a forwardly succeeding groove in the direction of circulation of the tracking projections 143. The stepped surfaces in the grooves 142A and 142A are arranged inversely to each other in the direction of circulation, so that the reciprocating members 122A and 122B can function as drives for forward and reverse rotations, respectively. Further, the outer ends of the grooves 142A and 142B of the second unidirectional conversion mechanisms are connected to circumferential idling grooves 147A and 147B in the same manner as in the case of the first unidirectional conversion mechanism between the rotating member and each reciprocating member.

The positions of the above-described circulative sunken track and the tracking projections as the interface of two coupled members may be switched, if desired, and each one of the sunken tracks may employ the groove selector mechanism as shown in the sixth embodiment of FIGS. 13 and 14.

In the above-described actuator construction, the first and second unidirectional conversion mechanisms on radially inner and outer sides of the reciprocating member 122A or 122B may be arranged arbitrarily to produce stepwise rotations in the same or different directions at the same or different stepping angles.

For example, in a case where the first and second unidirectional conversion mechanisms on the inner and outer sides of the reciprocating member 122A or 122B are of the same rotational direction, one axial reciprocating movement of the reciprocating member 122A or 122B causes the rotating member 123 to turn through an angle corresponding to the sum of the rotational angles determined by the pitch of the grooves of the sunken tracks on the inner and outer sides of the reciprocating member in question. On the other hand, in case the first and second unidirectional conversion mechanisms on the inner and outer sides of the reciprocating member are arranged for rotations in opposite directions, the rotating member is caused to turn through an angle corresponding to the difference between the rotational angles determined by the pitches of the sunken track grooves on the inner and outer sides of the reciprocating member.

More specifically, in case the sunken track grooves on one cylindrical surface are formed at a pitch of 60° (containing six pairs of grooves in total) and the sunken track grooves on the other cylindrical surface are formed at a pitch of 72° (containing five pairs of grooves in total), the rotating member is turned stepwise through 132 degrees corresponding to the sum of the stepping angles of the two overlapped unidirectional conversion mechanisms or through 12 degrees corresponding to the difference between the stepping angles of the two unidirectional conversion mechanisms on one axial reciprocating movement.

What is claimed is:

1. A stepping actuator for producing stepwise rotations of a predetermined stepping angle through conversion of rectilinear reciprocating motions, said stepping actuator comprising:

a rectilinearly reciprocating member received in an outer frame member;

a drive means for driving said rectilinearly reciprocating member back and forth in the axial direction within the outer frame member;

a rotating member located coaxially with said rectilinearly reciprocating member within said outer frame member and having an output shaft led out axially through said outer frame member;

an endless circulative sunken track formed on and around the circumference of one of cylindrical surfaces at the interface between said rectilinearly reciprocating member and said rotating member and consisting of a series of grooves connected end to end in zigzag shape with inclinations alternately in opposite directions relative to the generator of the cylindrical surface;

tracking projections retained on the other cylindrical surface and urged into engagement with the circulative sunken track for travel therealong;

a groove selector mechanism provided at the connected ends of said grooves to let the tracking projections select a forwardly succeeding at reversing points coinciding with reversals of axial movements of said reciprocating member; and a rotation blocking means provided at the interface between said rectilinearly reciprocating member sand said outer frame member for blocking rotational movements of said rectilinearly reciprocating member relative to the latter.

2. A stepping actuator as defined in claim 1, comprising:

a couple of rectilinearly reciprocating members located in axially aligned positions within said outer frame member for axial reciprocating movements independently of each other; and a single common rotating member coaxially fitted in said rectilinearly reciprocating members;

said circulative sunken track and said tracking projections being provided on cylindrical surfaces at the interface between said outer frame and also on cylindrical surfaces at the interface between said outer frame and the other one of said reciprocating members to provide independent forward and reverse drive mechanisms;

said grooves of said circulative sunken tracks having said groove selector mechanism arranged inversely to each other in the direction of circulation of said tracking projections to provide forward and reverse drives, and being connected to a circumferential idling groove at connected outer ends thereof.

3. A stepping actuator as defined in claim 2, wherein said circulative sunken track grooves are arranged to provide reversing points for said tracking projections at outer connected ends at the opposite sides of said zigzag sunken track.

4. A stepping actuator as defined in claim 2, wherein said tracking projections are resiliently pressed into said circulative sunken track, and said groove selector mechanism includes a downwardly stepped surface provided contiguously to the tail end of each groove of said sunken track and dropping the bottom surface of said sunken track to a deeper level at the head end of a forwardly succeeding groove in the direction of circulation, thereby letting said tracking projections positively select a forwardly succeeding groove on reversal of the axial movement of said rectilinearly reciprocating member at the ends of said grooves.

5. A stepping actuator as defined in claim 2, wherein said groove selector mechanism includes a straight portion provided in a head end portion of each groove of said circulative sunken track in the direction of the generator of said cylindrical surface and joining the tail end of a preceding groove a little short of a reversing point where the travel direction of said tracking projections is reversed in relation with the reversal of the axial movement of said rectilinearly reciprocating member.

6. A stepping actuator as defined in claim 2, wherein said groove selector mechanism on each one of said two circulative sunken tracks includes a straight portion provided in a head end portion of each groove in the direction of the generator of said cylindrical surface and joining the tail end of a preceding groove a little short of a reversing point where the travel direction of said tracking projections is reversed in relation with the reversal of the axial movement of said rectilinearly reciprocating member, and said circumferential idling groove in communication with grooves of one circulative sunken track is provided with recesses at spaced positions corresponding to straight head portions of the grooves on the other circulative sunken track for tentatively holding the tracking projections therein while said tracking projections in the other circulative sunken track are travelling along said straight head portions, thereby stabilizing the travel of said tracking projections along said straight head portions.

7. A stepping actuator as defined in claim 2, wherein said circumferential idling groove is formed shallower than said outer connected ends of said grooves, thereby ensuring said tracking projections to be positioned stably at predetermined stepping points by engagement with the deeper connected end portions during travel along said circulative sunken track.

8. A stepping actuator for producing stepwise rotations of a predetermined stepping angle through conversion of rectilinear reciprocating motions, said stepping actuator comprising:

a couple of rectilinearly reciprocating members located axially aligned positions within said outer frame member for axial reciprocating movements independently of each other;

a single common rotating member coaxially fitted in said rectilinearly reciprocating members;

a pair of outer endless circulative sunken tracks formed on and around one of cylindrical surfaces at the interfaces between said outer frame and each one of said rectilinearly reciprocating members, and a pair of inner endless circulative sunken tracks formed on and around one of cylindrical surfaces at the interfaces between said rotating member and each one of said rectilinearly reciprocating members, each one of said outer and inner sunken tracks being constituted by a series of grooves connected end to end in zigzag shape with inclinations alternately in opposite directions relative to the generator of said cylindrical surface;

tracking projections retained on the other cylindrical surface at each one of said interfaces and urged into engagement with said outer and inner circulative sunken tracks for travel therealong;

groove selector means provided at the connected ends of said grooves in said outer and inner circulative sunken tracks to let the tracking projections select a forwardly succeeding at reversing points coinciding with reversals of axial movements of the reciprocating members, said groove selector means in said outer circulative sunken tracks as well as the groove selector means in said inner circulative sunken tracks being arranged inversely to each other in the direction of circulation of said tracking projections to provide forward and reverse drive mechanisms; and a circumferential idling groove formed on and around said one cylindrical surface at each one of said interfaces in communication with outer connected ends of said grooves of said outer and inner circulative sunken tracks;

said grooves of said outer and inner circulative sunken tracks on the outer and inner sides of each one of said rectilinearly reciprocating members being arranged differently from each other in the stepping angle and the direction of circulation of said tracking projections.

9. A stepping actuator as defined in claim 2, wherein said outer frame member is in the form of a fluid cylinder adapted to apply a fluid pressure selectively to the opposite end faces of said rectilinearly reciprocating member or members or of said rectilinearly reciprocating rotatable member for driving same back and forth in the axial direction in the fashion of a piston.

* * * * *